US008496489B2

(12) United States Patent
Takatsu

(10) Patent No.: US 8,496,489 B2
(45) Date of Patent: Jul. 30, 2013

(54) CONNECTOR

(75) Inventor: Masayoshi Takatsu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 186 days.

(21) Appl. No.: 13/103,408

(22) Filed: May 9, 2011

(65) Prior Publication Data

US 2011/0271507 A1 Nov. 10, 2011

(30) Foreign Application Priority Data

May 7, 2010 (JP) ..... 2010-107552

(51) Int. Cl.
*H01R 13/62* (2006.01)

(52) U.S. Cl.
USPC ..... 439/157

(58) Field of Classification Search
USPC ..... 439/157, 372
See application file for complete search history.

(56) References Cited

U.S. PATENT DOCUMENTS

| | | | | |
|---|---|---|---|---|
| 5,611,703 | A * | 3/1997 | Okamoto et al. | 439/157 |
| 7,172,442 | B2 * | 2/2007 | Fukatsu | 439/157 |
| 7,255,581 | B2 | 8/2007 | Yamaoka | |
| 7,347,704 | B2 | 3/2008 | Tsuji | |
| 8,353,712 | B2 * | 1/2013 | Makino | 439/157 |
| 2002/0173185 | A1 | 11/2002 | Fukushima et al. | |
| 2007/0099461 | A1 | 5/2007 | Pittenger et al. | |
| 2007/0249206 | A1 | 10/2007 | Ishikawa | |
| 2009/0163059 | A1 | 6/2009 | Kobayashi | |

* cited by examiner

*Primary Examiner* — Phuong Dinh
(74) *Attorney, Agent, or Firm* — Gerald E. Hespos; Michael J. Porco; Matthew T. Hespos

(57) ABSTRACT

A force multiplying member (30) is mounted rotatably on supports of a first housing (10) and is guided slidably relative to the first housing (10). In a connecting process of the two housings (10, 20), the force multiplying member (30) successively performs a rotational movement that displays a force multiplying action by causing tracks (39) for rotational movement and cam followers (23) to slide and a sliding movement that displays a force multiplying action by causing tracks (40) for sliding movement and the cam followers (23) to slide.

6 Claims, 6 Drawing Sheets

CONNECTOR

BACKGROUND OF THE INVENTION

1. Field of the Invention

The invention relates to a connector.

2. Description of the Related Art

U.S. Pat. No. 7,255,581 discloses a connector in which a lever is rotatably mounted on a first housing. The first housing is fit lightly to a second housing so that cam followers of the second housing enter tracks of the lever. The two housings are connected by a force multiplying action displayed by rotating the lever in this state and engaging the tracks and the cam followers.

The lever of U.S. Pat. No. 7,255,581 has an operable portion that moves in a circumferential direction around the first housing as the lever rotates. Thus, an arcuate operation space is necessary to allow movement of the operable portion. An operation force can be reduced by enhancing a force multiplying effect in this connector. However, an angle of rotation of the lever then needs to be increased. Therefore the operation space has to be ensured over a wide range.

U.S. Pat. No. 7,347,704 discloses a connector in which a slider is mounted slidably on a first housing, the first housing is fit lightly to a second housing to cause cam followers of the second housing to enter tracks of the slider. The two housings are connected by a force multiplying action displayed by sliding the slider in this state and engaging the tracks and the cam followers.

The slider of U.S. Pat. No. 7,347,704 has an operable portion that moves back and forth at a lateral side of the first housing with sliding movements of the slider. Thus, a linear operation space is necessary to allow a movement of the operable portion at the lateral side of the first housing. An operation force can be reduced by enhancing a force multiplying effect in this connector. However, a sliding distance of the slider would need to be increased. Therefore the operation space has to be ensured over a wide range.

In the both above connectors, a large displacement amount of the lever or slider cannot be ensured if the operation space is limited. Thus, the operation force may increase to reduce operability.

The invention was developed in view of the above situation and an object thereof is to enable an improvement in operability even if an operation space is limited.

SUMMARY OF THE INVENTION

The invention relates to a connector with a first housing that is connectable with a second housing by the operation of a force multiplying member. The first housing and the force multiplying member include supports for rotatably supporting the force multiplying member on the first housing. The first housing and the force multiplying member include guides for guiding the force multiplying member while enabling a sliding movement of the force multiplying member in a direction crossing a connecting direction of the housings. The force multiplying member includes a track for rotational movement and a track for sliding movement. The track for rotational movement can slide in contact with a cam follower for rotational movement relative to the second housing as the force multiplying member is rotated. The track for sliding movement can slide in contact with a cam follower for sliding movement relative to the second housing as the force multiplying member is slid; and in the connecting process of the first and second housings, the force multiplying member successively performs rotational and sliding movements. The rotational movement displays a force multiplying action by causing the track for rotational movement and the cam follower for rotational movement to slide. The sliding movement displays a force multiplying action by causing the track for sliding movement and the cam follower for sliding movement to slide.

Part of the connecting process of the housings is performed by the rotational movement of the force multiplying member and another part is performed by sliding movement of the force multiplying member. An angle of rotation of the force multiplying member is reduced to a smaller angle as compared with a case where only the force multiplying member is rotated. Similarly, a sliding distance of the force multiplying member is reduced to a shorter distance as compared with the case where the force multiplying member only slides in the entire process. Accordingly, changing displacement ranges of the rotational and sliding movements of the force multiplying member ensures a large displacement amount of the force multiplying member to improve operability even if there is a limited space for the operation of the force multiplying member.

The track for rotational movement and the track for sliding movement preferably communicate with each other and a common cam follower preferably serves as the cam follower for rotational movement and the cam follower for sliding movement. Thus, the shape of the second housing can be simplified.

The support of the force multiplying member preferably is a supporting hole and the guide of the force multiplying member preferably is a guiding groove. The guiding groove and the supporting hole communicate with each other.

A common projection preferably functions as the supporting of the first housing and the guide of the first housing. Thus, the shape of the first housing can be simplified.

The force multiplying member preferably performs a rotational movement from an initial stage to an intermediate stage of a connection of the housings and a sliding movement from the intermediate stage to the end of the connection of the housings.

These and other objects and advantages of the invention will become more apparent upon reading of the following detailed description of preferred embodiments and accompanying drawings.

DETAILED DESCRIPTION OF THE PREFERRED EMBODIMENTS

Figure 1:
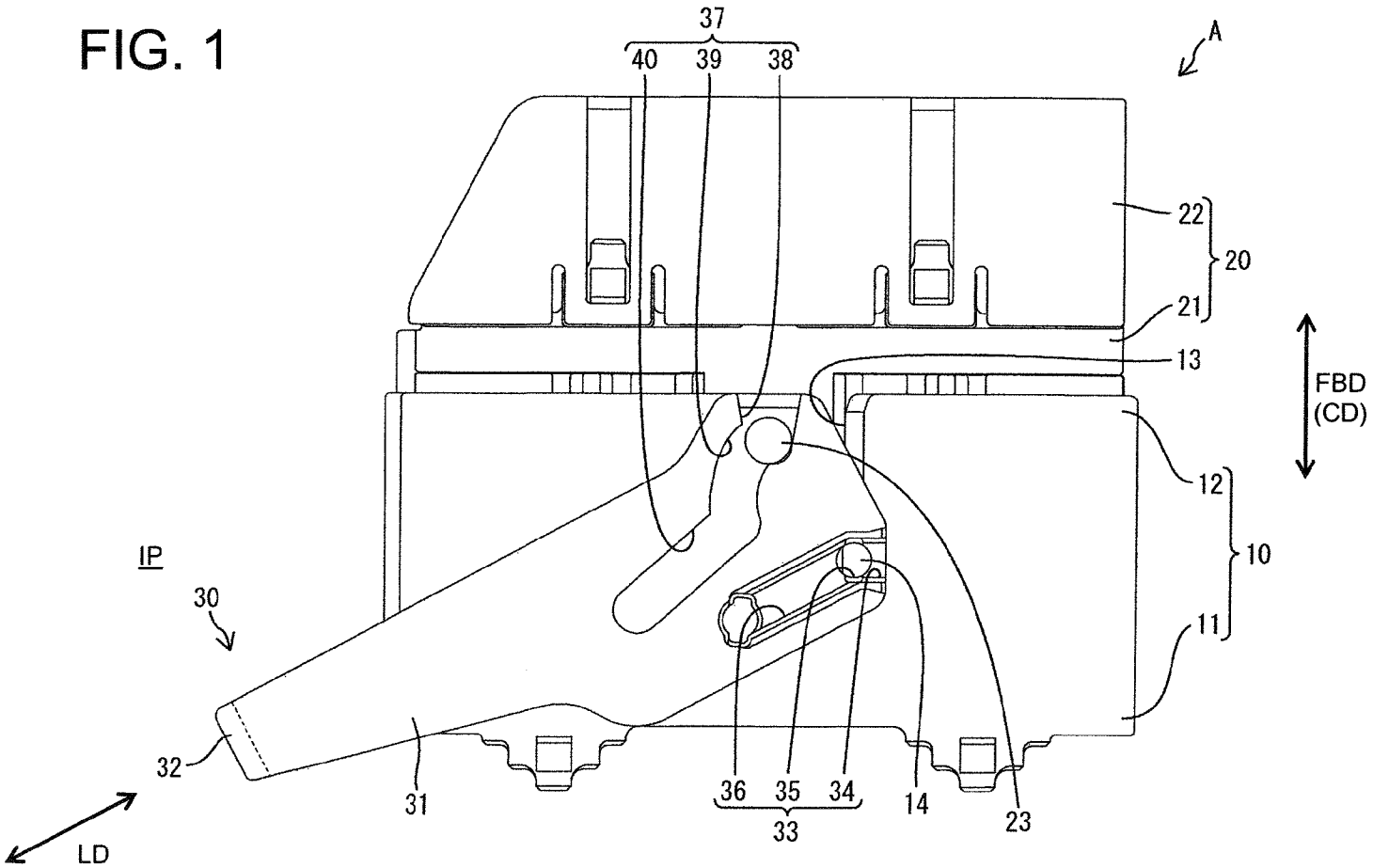
FIG. 1 is front view showing a state where a force multiplying member is at an initial position and a connecting operation of two housings is started in a first embodiment.
Figure 2:
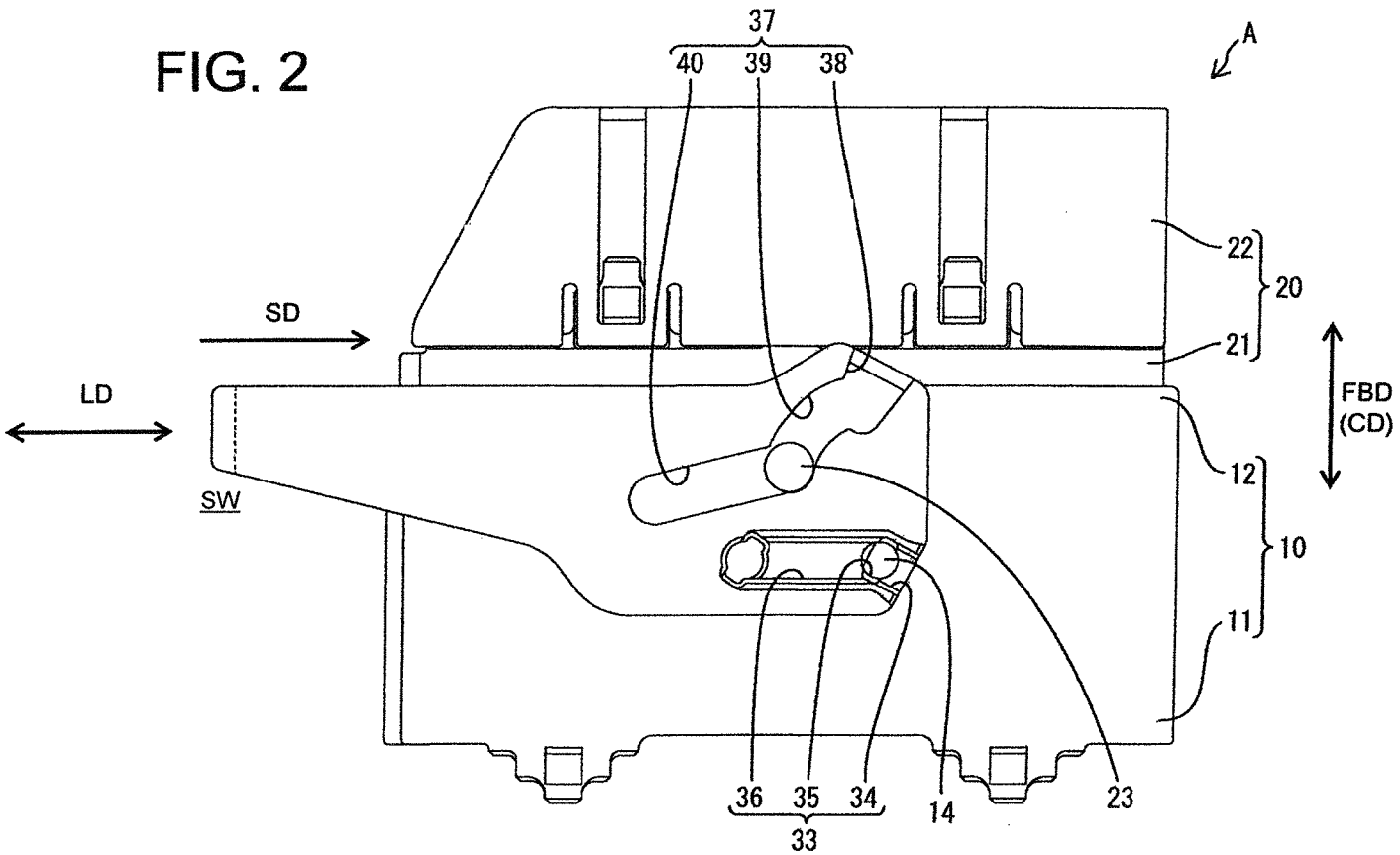
FIG. 2 is a front view showing a state where the force multiplying member is displaced to a switching position in the process of connecting the two housings.
Figure 3:
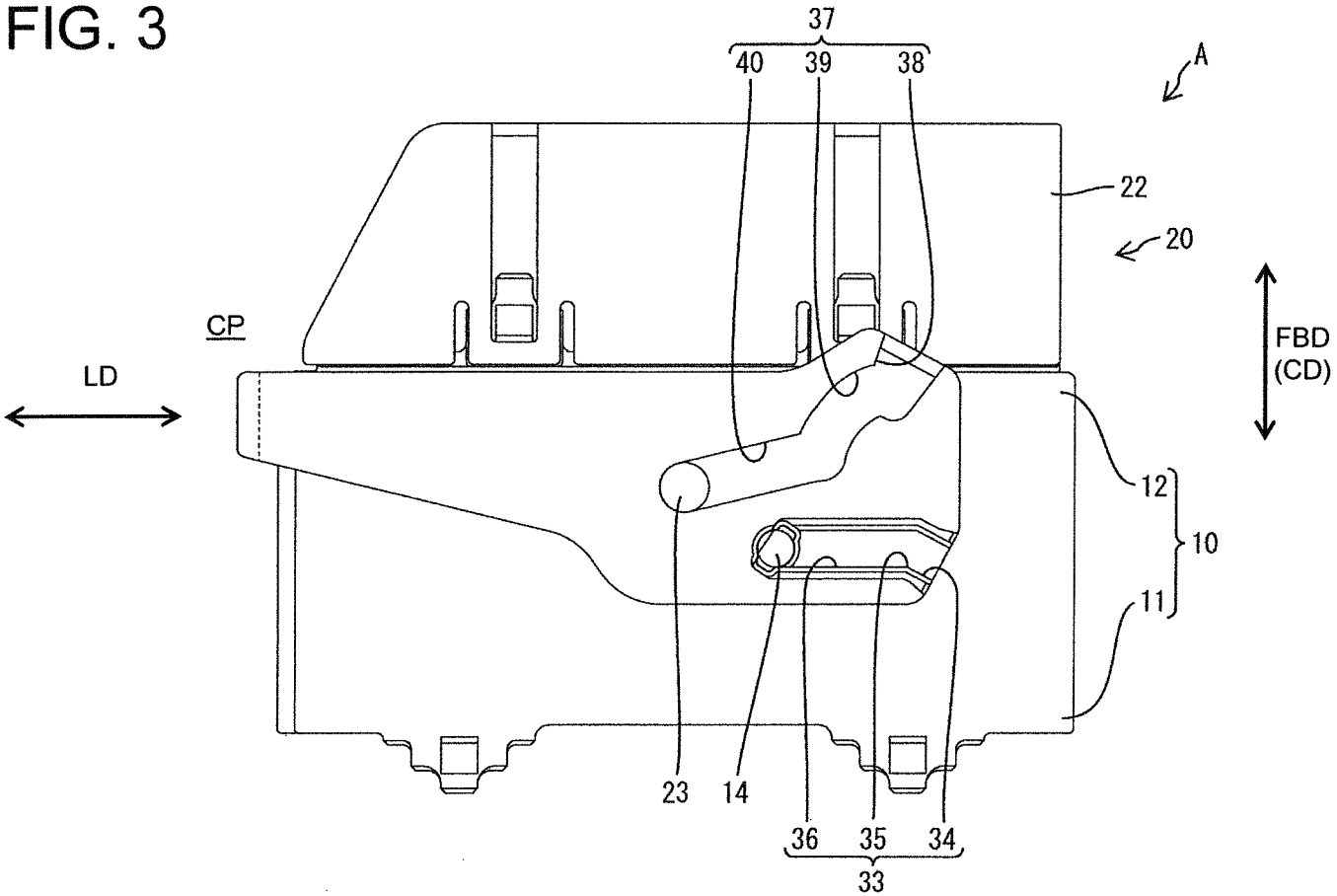
FIG. 3 is a front view showing the force multiplying member displaced to a connection position and the connecting operation of the two housings completed.

A first embodiment of the invention is described with reference to FIGS. 1 to 3. A connector A of this first embodiment has first and second housings 10 and 20 that can be connected by operating a force multiplying member 30 mounted on the first housing 10. In the following description, vertical and lateral directions are the same as those shown in FIGS. 1 to 3, and a side shown on the planes of FIGS. 1 to 3 is referred to as a front concerning forward and backward directions FBD.

The first housing 10 is of a known shape and has a terminal holding portion 11 and a receptacle 12 that extends up from the terminal holding portion 11. Male terminal fittings (not shown) of a known form are held in the terminal holding portion 11 and the receptacle 12 surrounds tabs of the male terminal fittings.

The front and rear walls of the receptacle 12 have substantially symmetrical front and rear escaping grooves 13 that extend down from the upper end edges. The escaping grooves 13 are substantially in the center of the first housing 10 in the lateral direction, which is substantially orthogonal to a connecting direction CD of the two housings 10, 20 and substantially orthogonal to a central axis of rotation of the force multiplying member 30. The escaping groove 13 in the rear wall is not shown.

Projections 14 are arranged on the receptacle 12. Front and rear substantially symmetrical and substantially cylindrical projections 14 are substantially concentric with each other on the outer surfaces of the front and rear walls of the receptacle 12 so that axis lines thereof extend in substantially forward and backward directions FBD. In the lateral direction, the projections 14 are offset (e.g. to the right) of the central position (escaping grooves 13) of the first housing 10.

The second housing 20 is formed by assembling a main body 21 to be fit into the receptacle 12 from above and a wire cover 22 for covering the upper side of the main body 21. Female terminal fittings (not shown) of a known form are accommodated in the housing main body 21 and are connectable to the respective male terminal fittings. Wires (not shown) connected to the respective female terminal fittings are drawn out from the upper surface of the housing main body 21, are bent in the wire cover 22, and drawn out substantially laterally (e.g. rightward) to the outside from the wire cover 22.

Cam followers 23 are provided on the main body 21. Front and rear substantially symmetrical cylindrical cam followers 23 are arranged substantially concentrically with each other on the front and rear outer surfaces of the housing main body 21 so that axis lines thereof extend in forward and backward directions. The cam followers 23 are arranged at a laterally central position of the second housing 20 and in a position corresponding to the escaping grooves 13.

The force multiplying member 30 is a unitary structure with front and rear symmetrical plate-like arms 31 aligned substantially parallel to the front and rear surfaces of the first housing 10 and an operable portion 32 connects ends of the arms 31 at one side in a longitudinal direction LD. Grooves 33 are formed in the arms 31 of the force multiplying member 30. More particularly, front and rear substantially symmetrical grooves 33 are formed in the arms 31 and communicate between the inner and outer surfaces of the arms 31. An assembling opening 34 is formed in the end of each groove 33 at the outer peripheral edge of the end of the arm 31 opposite the operable portion 32 in the longitudinal direction LD. The end of each groove 33 opposite the assembling opening 34 is closed. A supporting hole 35 communicates with each groove 33 at a position on the respective arm 31 slightly back from the assembling opening 34. A long substantially straight guiding groove 36 extends along each groove 33 in a direction substantially parallel to the longitudinal direction LD of the arm 31 from the supporting hole 35 to the back end extending substantially. The starting end of the guiding groove 36 communicates with the supporting hole 35.

Front and rear cam grooves 37 are formed substantially symmetrically in each arm 31 and communicate between the inner and outer surfaces of each arm 31. Each cam groove 37 has an entrance opening 38, a track 39 for rotational movement and a track 40 for sliding movement. The entrance opening 38 is at the starting end of the cam groove 37 and opens at a position on the outer peripheral edge of the arm 31 near the assembling opening 34 and in an area between the operable portion 32 and the assembling opening 34. Each track 39 for rotational movement has a bent, spiral-like or substantially arcuate shape centered on a position deviated from the supporting hole 35. The starting end of the track 39 for rotational movement communicates with the entrance opening 38. Each track 40 for sliding movement extends substantially straight in a direction oblique to the guiding groove 36. The starting end of the track 40 for sliding movement communicates with the back end of the track 39 for rotational movement.

The force multiplying member 30 is mounted at an initial position IP on the first housing 10 before connecting the first and second housings 10, 20. More particularly, the arms 31 sandwich the first housing 10 and the assembling openings 34 engage the projections 14. The projections 14 are engaged with the supporting holes 35 while the force multiplying member 30 is held at the initial position IP. Additionally, the entrance openings 38 of the cam grooves 37 are at the end that mates with the second housing 20 and are positioned to correspond to the escaping grooves 13 in the lateral direction, as shown in FIG. 1.

The longitudinal directions LD of the arms 31 extend substantially laterally when the force multiplying member 30 is at the initial position IP and the assembling openings 34 open laterally (e.g. rightward). The operable portion 32 is at the side (e.g. left) of the first housing 10 and a distance between the operable portion 32 and the left surface of the first housing 10 is relatively long. The guiding grooves 36 and the tracks 40 for sliding movement are oblique to both the vertical direction (direction parallel to the connecting direction CD of the housings 10, 20) and the lateral direction, and the back ends thereof are diagonally behind and to the left of the starting ends.

The second housing 20 is brought closer to the first housing 10 from above and is fit lightly into the receptacle 12 while the force multiplying member 30 is at the initial position IP. Thus, the cam followers 23 pass the entrance openings 38 and move into the escaping grooves 13 to positions at the starting ends of the tracks 39 for rotational movement as shown in FIG. 1. An operator then grips the operable portion 32 and rotates the force multiplying member 30 (e.g. clockwise) about the projections 14 to a switching position SW. During this time, the projections 14 and the supporting holes 35 remain substantially coaxial and the operable portion 32 is displaced up along an arcuate path along the lateral surface of the first housing 10. Further, the distance between the operable portion 32 and the lateral surface of the first housing 10 does not vary largely and the operable portion 32 is kept relatively distant from the lateral surface of the first housing 10.

The cam followers 23 and the tracks 39 for rotational movement slide in contact as the force multiplying member 30 is rotated and display a force multiplying action that brings the housings 10, 20 closer together. The cam followers 23 reach the back ends of the tracks 39 for rotational movement when the rotated force multiplying member 30 reaches the switching position SW shown in FIGW. 2. However, the connection of the housings 10, 20 is not completed when the force multiplying member 30 is at the switching position SW. At the switching position SW, the guiding grooves 36 extend substantially laterally and substantially orthogonal to the connecting direction CD of the housings 10, 20 and the tracks 40 for sliding movement are oblique to the lateral direction.

The operable portion 32 then is pushed laterally from the left. Thus, the force multiplying member 30 is guided by the sliding contact of the projections 14 and the guides 36 to move laterally in a slide direction SD that is substantially orthogonal to the connecting direction CD of the two housings 10, 20. The operable portion 32 approaches the lateral surface of the first housing 10 as the force multiplying member 30 is slid. The sliding contact of the tracks 40 for sliding movement and the cam followers 23 displays a force multiplying action as the force multiplying member 30 is slid, and the two housings 10, 20 are brought closer to each other. The cam followers 23 reach the back ends of the tracks 40 for sliding movement and the projections 14 reach the back ends of the guiding grooves 36 when the force multiplying member 30 reaches a connection position CP shown in FIG. 3, and the two housings 10, 20 are connected properly.

As described above, the two housings 10, 20 can be connected by rotating the force multiplying member 30 and then sliding the force multiplying member 30. During this time, an operator does not need to move his hand from the operable portion 32 or grip the operable portion 32 in a different manner. Therefore operational efficiency is good. The two housings 10, 20 can be separated by first sliding the force multiplying member 30 laterally from the connecting position CP to the switching position SW and then rotating the force multiplying member 30 (e.g. counterclockwise) to the initial position IP.

The first housing 10 and the force multiplying member 30 have the projections 14 and the supporting holes 35 as the supports for rotatably supporting the force multiplying member 30 on the first housing 10. Additionally, the guiding grooves 36 and the projections 14 guide the force multiplying member during a sliding movement relative to the first housing 10 in the sliding direction SD that crosses the connecting direction CD of the housings 10, 20. The force multiplying member 30 also has the tracks 39 for rotational movement that can slide in contact with the cam followers 23 of the second housing 20 as the force multiplying member 30 is rotated and the tracks 40 for sliding movement that can slide in contact with the cam followers 23 as the force multiplying member 30 is slid. The force multiplying action is displayed during a first part of the connecting process by the sliding movements of the tracks 39 for rotational movement with the cam followers 23 caused by rotating the force multiplying member 30. The force multiplying action is displayed during a second part of the connecting process by the sliding movements of the tracks 40 for sliding movement with the cam followers 23 caused by sliding the force multiplying member 30.

According to this construction, an angle of rotation of the force multiplying member 30 in the connecting process is smaller than in the case where the force multiplying member rotates in the entire process. Similarly, a sliding distance of the force multiplying member 30 in the connecting process is shorter than in the case where the force multiplying member is slid in the entire process. Displacement ranges of the rotational and sliding movements of the force multiplying member 30 can be changed according to an operation space around the connector A. Thus, even if there is a limit to the space that can be ensured for the operation of the force multiplying member 30, operability can be improved by ensuring a large displacement amount of the force multiplying member 30.

The tracks 39 for rotational movement and the tracks 40 for sliding movement communicate with each other. Also, the same cam followers 23 slide in contact with the tracks 39 for rotational movement and slide in contact with the tracks 40 for sliding movement. Accordingly, the shape of the second housing 20 with the cam followers 23 is simplified.

The supporting holes 35 support the force multiplying member 30 and the guiding grooves 36 guide the force multiplying member 30. The guiding grooves 36 and the supporting holes 35 communicate with each other and the projections 14 serve as the supports and the guides of the first housing 10. Accordingly, the shape of the first housing 10 can be simplified.

Figure 4:
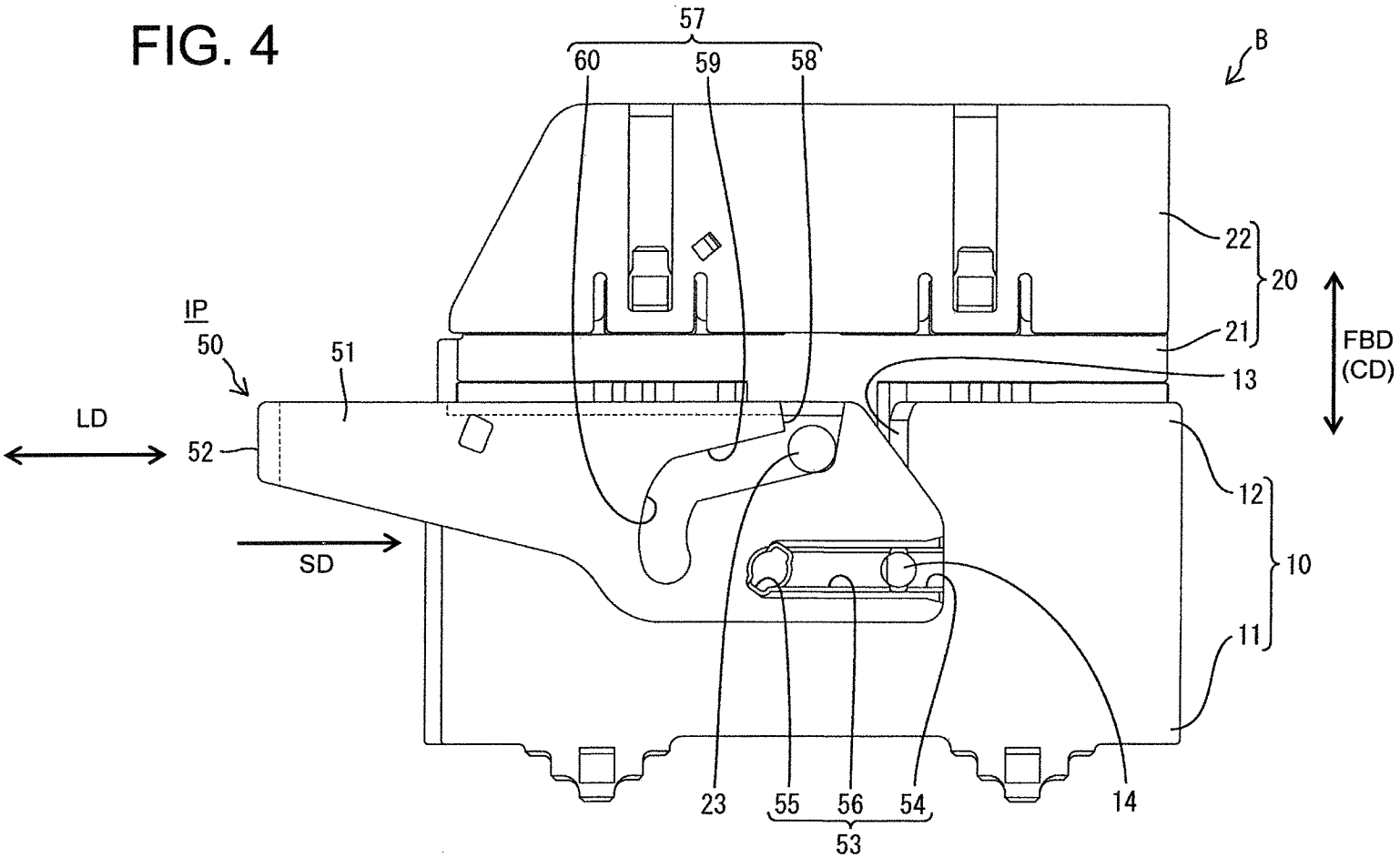
FIG. 4 is a front view showing a force multiplying member at an initial position and a connecting operation of two housings is started in a second embodiment.
Figure 5:
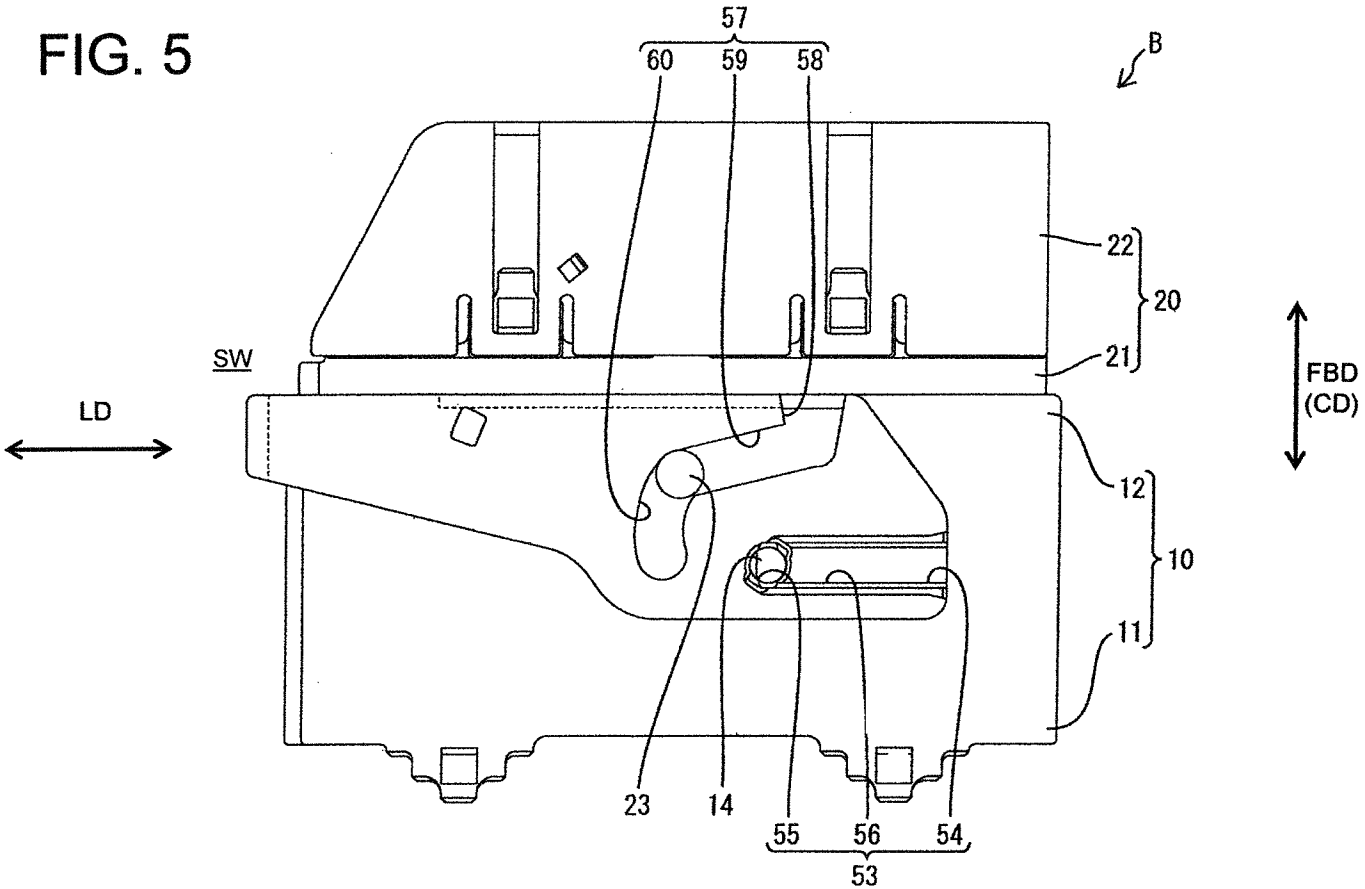
FIG. 5 is a front view showing a state where the force multiplying member is displaced to a switching position in the process of connecting the housings.
Figure 6:
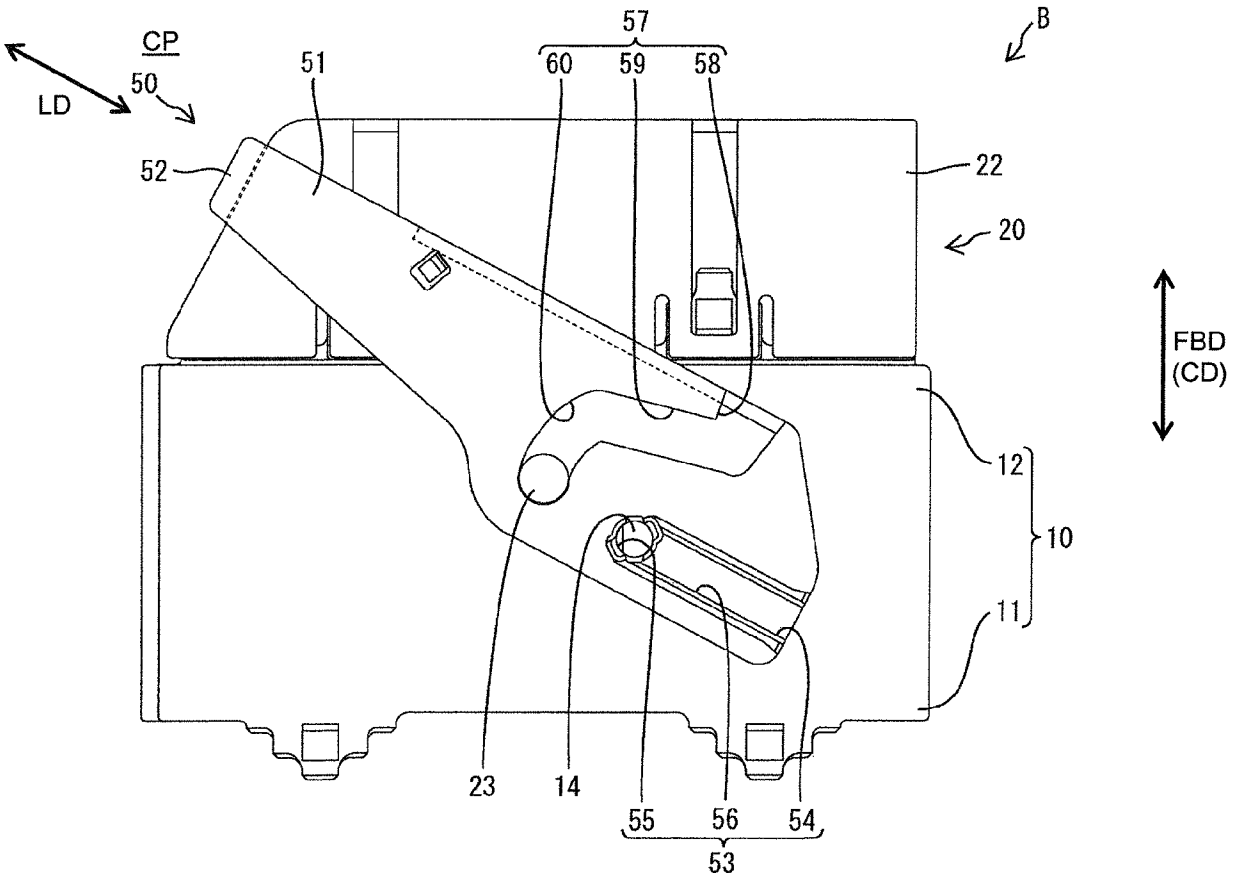
FIG. 6 is a front view showing the force multiplying member displaced to a connection position and the connecting operation of the housings completed.

A second embodiment of the invention is described with reference to FIGS. 4 to 6. A connector B of the second embodiment is designed so that a first and second housing 10 and 20 that are similar to the housings of the first embodiment are connected by operating of a force multiplying member 50. The force multiplying member 50 is mounted on the first housing 10. In the following description, vertical and lateral directions are the same as those shown in FIGS. 4 to 6, and a side shown on the planes of FIGS. 4 to 6 is referred to as a front side concerning forward and backward directions FBD.

The force multiplying member 50 has two symmetrical plate-like arms 51 joined unitarily by an operable portion 52. The arms 51 are parallel to the front and rear surfaces of the first housing 10 and the operable portion 52 connects longitudinal ends of the arms 51. Front and rear symmetrical grooves 53 are formed in both arms 51 and communicate between the front and rear surfaces (inner and outer surfaces) of the arms 51. An assembling opening 54 is formed at one end of each groove 53 at the outer peripheral edge of the end of the arm 51 opposite the operable portion 52 in the longitudinal direction. The back end of each groove 53 is closed and functions as a supporting hole 55. A long area of each groove 53 between the assembling opening 54 and the supporting hole 55 defines a guiding groove 56 that extends substantially straight in a direction substantially parallel to the longitudinal direction LD of the arm 51. The starting end of the guiding groove 56 communicates with the assembling opening 54 and the back end of the guiding groove 56 communicates with the supporting hole 55.

The arms 51 are formed with front and rear symmetrical cam grooves 57 communicating between the front and rear surfaces (inner and outer surfaces) of the arms 51. Each cam groove 57 has an entrance opening 58, a track 59 for sliding movement and a track 60 for rotational movement. The entrance opening 58 is at the starting end of the cam groove 57 and opens at a position of the outer peripheral edge of the arm 51 near the assembling opening 54 in an area between the operable portion 52 and the assembling opening 54. Each track 59 for sliding movement extends substantially straight in a direction oblique to the guiding groove 56. The starting end of the track 59 for sliding movement communicates with the entrance opening 58. Each track 60 for rotational movement has a spiral-like or substantially arcuate shape centered on a position deviated from the supporting hole 55. The starting end of the track 60 for rotational movement communicates with the back end of the track 59 for sliding movement.

The force multiplying member 50 is mounted at an initial position IP on the first housing 10 before connecting the first and second housings 10, 20. More particularly, the assembling openings 54 are engaged with the projections 14 so that the first housing 10 is sandwiched between the arms 51 from the front and rear. With the force multiplying member 50 at the initial position IP, the projections 14 engage the starting ends of the guiding grooves 56 and the entrance openings 58 of the cam grooves 57 are at an upper side toward which the second housing 20 approaches when connecting the two housings 10, 20 and corresponds to escaping grooves 13 in the lateral direction, as shown in FIG. 4.

The longitudinal directions LD of the arms 51 extend substantially in the lateral direction and cross the connecting direction CD of the two housings 10, 20 when the force multiplying member 50 is at the initial position IP. Additionally, the assembling openings 54 open laterally (e.g. rightward) at the initial position. The operable portion 52 is located laterally (e.g. left) of the first housing 10 and a distance between the operable portion 52 and the lateral surface of the first housing 10 when the operable portion 52 is at the initial position IP is longest in a displacing process of the force multiplying member 50 that accompanies the connecting operation of the two housings 10, 20. The guiding grooves 56 extend laterally and substantially orthogonal to the connecting direction CD of the two housings 10, 20, whereas the tracks 59 for sliding movement extend in a direction oblique to the lateral direction.

The second housing 20 is brought closer to the first housing 10 from above and is fit lightly into a receptacle 12 with the force multiplying member 50 at the initial position IP. Thus, cam followers 23 pass the entrance openings 58 while entering the escaping grooves 13 and are located at the starting ends of the tracks 59 for sliding movement, as shown in FIG. 4.

The operable portion 52 then is gripped and pushed laterally, e.g. from the left. Thus, the force multiplying member 50 slides laterally (e.g. to the right) and substantially orthogonal to the connecting direction CD of the housings 10, 20 while being guided by the sliding contact of the projections 14 and the guiding grooves 56. The operable portion 52 approaches the lateral surface of the first housing 10 to narrow the distance between them as the force multiplying member 50 is slid. A force multiplying action is displayed by the sliding contact of the tracks 59 for sliding movement and the cam followers 23 as the force multiplying member 50 is slid, and the housings 10, 20 are brought closer to each other.

The cam followers 23 reach the back ends of the tracks 59 for sliding movement or starting ends of the tracks 60 for rotational movement when the force multiplying member 50 reaches a switching position SW shown in FIG. 5, and the projections 14 reach the supporting holes 55 at the back ends of the guiding grooves 56. The connecting operation of the two housings 10, 20 is not completed when the force multiplying member 50 reaches the switching position SW.

The force multiplying member 50 then is rotated (e.g. clockwise) about the projections 14 from the switching position SW to a connection position CP. The projections 14 and the supporting holes 55 remain substantially coaxial during this rotation and the operable portion 52 is displaced up along an arcuate path along the left surface of a wire cover 22 of the second housing 20. The operable portion 52 is kept close to the left surface of the wire cover 22 during this rotation. The cam followers 23 and the tracks 60 for rotational movement slide in contact to display a force multiplying action as the force multiplying member 50 is rotated and the two housings 10, 20 are brought closer together. The cam followers 23 reach the back ends of the tracks 60 for rotational movement when the rotated force multiplying member 50 reaches the connection position CP shown in FIG. 6, and the two housings 10, 20 are connected properly.

As described above, the two housings 10, 20 can be connected by sliding the force multiplying member 50 and then rotating the force multiplying member 50. During this time, an operator can keep his hand on the operable portion 52 and need not grip the operable portion 52 in a different manner. Therefore operability is good. The two housings 10, 20 are separated by rotating the force multiplying member 50 (e.g. counterclockwise) from the connecting position CP to the switching position SW and then sliding to the left and to the initial position IP.

In the connector B of the second embodiment, the first housing 10 and the force multiplying member 50 have the projections 14 and the supporting holes 55 for rotatably supporting the force multiplying member 50 on the first housing 10. Additionally, the guiding grooves 56 and the projections 14 guide the force multiplying member 50 along a sliding movement relative to the first housing 10 in the direction SD that crosses the connecting direction CD of the two housings 10, 20. The force multiplying member 50 also has the tracks 60 for rotational movement that can slide in contact with the cam followers 23 of the second housing 20 as the force multiplying member 50 is rotated. The force multiplying member 50 further has the tracks 59 for sliding movement that can slide in contact with the cam followers 23 as the force multiplying member 50 is slid. A part of the connecting process of the two housings 10, 20 is caused by the force multiplying action displayed by sliding movements of the tracks 59 for sliding movement relative to the cam followers 23 as the force multiplying member 50 is slid and another part of the connecting process is caused by the force multiplying action displayed by the sliding movements of the tracks 60 for rotational movement and the cam followers 23 as the force multiplying member 50 is rotated.

According to this construction, a sliding distance of the force multiplying member 50 in the connecting process is reduced as compared with a case where the force multiplying member only is slid in the entire process. Similarly, an angle of rotation of the force multiplying member 50 in the connecting process is reduced as compared with the case where the force multiplying member only is rotated in the entire process. Displacement ranges of the sliding and rotational movements of the force multiplying member 50 can be changed or adapted to an operation space that can be ensured around the connector B. Thus, even if there is a limit to the space that can be ensured for the operation of the force multiplying member 50, operability can be improved by ensuring a large displacement amount of the force multiplying member 50.

Further, the tracks 59 for sliding movement and the tracks 60 for rotational movement communicate with each other, and the common cam followers 23 serves as cam followers for rotational movement that slide in contact with the tracks 60 for rotational movement and cam followers for sliding movement that slide in contact with the tracks 59 for sliding movement. Accordingly, the shape of the second housing 20 is simplified.

The supporting portions of the force multiplying member 50 are the supporting holes 55, the guiding portions are the guiding grooves 56. The guiding grooves 56 and the supporting holes 55 communicate with each other and the common projections 14 serve as the supporting portion and the guiding portion of the first housing 10. Accordingly, the shape of the first housing 10 is simplified.

The invention is not limited to the above described and illustrated embodiments. For example, the following embodiments are also included in the scope of the invention.

Although the common cam follower is the cam follower for rotational movement and the cam follower for sliding movement in the above embodiments, the cam follower for rotational movement and the cam follower for sliding movement may be separate.

Although the tracks for rotational movement communicate with the tracks for sliding movement in the above embodiments, they may not communicate.

Although the common projection serves as the support and the guide of the first housing in the above embodiments, the support and the guide of the first housing may be separate.

Although the supporting hole and the guiding groove of the force multiplying member communicate with each other in the above embodiments, they may not communicate.

Although only one cam follower is provided for one arm in the above embodiments, a plurality of cam followers may be provided for one arm.

Although the support of the first housing is a projection and the support of the force multiplying member is a hole in the above embodiments, the support of the first housing may be a hole and the support of the force multiplying member may be a projection.

Although the guiding portion of the first housing is in the form of a projection (projection) and that of the force multiplying member is in the form of a groove (guiding groove), the guiding portion of the first housing may be in the form of a groove and that of the force multiplying member may be in the form of a projection.

Although the force multiplying member performs one rotational movement and one sliding movement in the connecting process of the two housings in the above embodiments, it may perform at least either one of the rotational movement and the sliding movement a plurality of times in the connecting process of the two housings.

Although the force multiplying member has a two arms in the above embodiments, it may have only a single (particularly substantially plate-like) arm.

What is claimed is:

1. A connector comprising:

a first housing;

a second housing connectable with the first housing along a connecting direction, the second housing including at least one cam follower;

a force multiplying member;

the first housing and the force multiplying member including supports for rotatably supporting the force multiplying member on the first housing;

the first housing and the force multiplying member including guides for guiding a sliding movement of the force multiplying member relative to the first housing in a direction crossing the connecting direction of the two housings;

the force multiplying member including a track for rotational movement that can slide in contact with the cam follower as the force multiplying member is rotated and a track for sliding movement that can slide in contact with the cam follower as the force multiplying member is slid, wherein the force multiplying member successively or alternately performs a rotational movement that displays a force multiplying action by causing the track for rotational movement and the cam follower to slide and a sliding movement that displays a force multiplying action by causing the track for sliding movement and the cam follower to slide.

2. The connector of claim 1, wherein the track for rotational movement and the track for sliding movement communicate with each other.

3. The connector of claim 1, wherein: the support of the force multiplying member is a supporting hole, the guide of the force multiplying member is a guiding groove; and the guiding groove and the supporting hole communicate with each other.

4. The connector of claim 1, wherein a common projection functions as the support of the first housing and the guide of the first housing.

5. The connector of claim 1, wherein the force multiplying member is configured to perform a rotational movement from an initial stage to an intermediate stage of a connecting operation of the first and second housings and a sliding movement from the intermediate stage to an end of the connecting operation of the first and second housings.

6. The connector of claim 1, wherein the force multiplying member is configured to perform a sliding movement from an initial stage to an intermediate stage of a connecting operation of the first and second housings and a rotational movement from the intermediate stage to the end of the connecting operation of the first and second housings.

* * * * *